US005417164A

United States Patent [19]

Nishida et al.

[11] Patent Number: 5,417,164

[45] Date of Patent: May 23, 1995

[54] THERMOSENSITIVE RECORDING MATERIAL AND THERMOSENSITIVE RECORDING METHOD

[75] Inventors: Manabu Nishida, Suita; Masahiro Yoshida, Kyoto; Tatsuhito Matsuda, Kobe; Yoshikuni Mori, Takatsuki; Masatoshi Yoshida, Nara, all of Japan

[73] Assignee: Nippon Shokubai Co., Ltd., Osaka, Japan

[21] Appl. No.: 21,085

[22] Filed: Feb. 23, 1993

Related U.S. Application Data

[63] Continuation-in-part of Ser. No. 918,051, Jul. 24, 1992, abandoned.

[30] Foreign Application Priority Data

Jul. 24, 1991 [JP] Japan ..... 3-208412

[51] Int. Cl.[6] ..... B41N 1/14; B41C 1/055; B41C 1/06

[52] U.S. Cl. ..... 101/453; 101/462; 101/467; 156/234; 156/238; 156/240

[58] Field of Search ..... 101/453, 457, 462, 463.1, 101/465, 466, 467; 156/234, 235, 238, 239, 240

[56] References Cited

U.S. PATENT DOCUMENTS 5,269,865 12/1993 Kushida et al. ..... 156/240

FOREIGN PATENT DOCUMENTS 160395 11/1985 European Pat. Off. ..... 101/467
160396 11/1985 European Pat. Off. ..... 101/467
2802085 7/1978 Germany ..... 101/467
49202 4/1979 Japan ..... 101/467
13168 2/1981 Japan ..... 101/467
193154 11/1983 Japan ..... 101/467
211051 11/1984 Japan .
177459 8/1986 Japan ..... 101/453
64747 3/1988 Japan ..... 101/453

*Primary Examiner*—Edgar S. Burr
*Assistant Examiner*—Stephen R. Funk
*Attorney, Agent, or Firm*—Oblon, Spivak, McClelland, Maier, & Neustadt

[57] ABSTRACT

A thermosensitive recording material comprising a recording layer formed on a substrate and a coating film layer formed thereon, wherein the recording layer is of a bilayer structure composed of a first thermosensitive layer on the side of the lower layer and a second thermosensitive layer on the side of the upper layer and particles are dispersed in at least one of the first and second thermosensitive layers. An original plate for lithographic printing can be produced from a combination of an ink-philic resin and an ink-repelling resin as the compositional materials of such thermosensitive layers. Besides, thermosensitive, recording materials for magnetic recording, thermosensitive materials for electrostatic recording, thermosensitive recording materials for colored image recording and the like, can be generated through a variety of modifications of the compositional materials. Then, the use of such thermosensitive recording materials attains thermosensitive recording at a higher precision through simple processes and procedures.

31 Claims, 1 Drawing Sheet

THERMOSENSITIVE RECORDING MATERIAL AND THERMOSENSITIVE RECORDING METHOD

This is a continuation-in-part of U.S. application Ser. No. 07/918,051 filed Jul. 24, 1992, now abandoned.

BACKGROUND OF THE INVENTION

1. Field of the Invention

The present invention relates to a thermosensitive recording material and a thermosensitive recording method. More specifically, the present invention relates to a thermosensitive recording material and a thermosensitive recording method, characterized in that thermosensitive recording can be done at a higher sharpness by means of a relatively simple process. The thermosensitive recording material in accordance with the present invention can be applied extensively as original plates for lithographic printing, OHP recording plates, original plates for electrostatic recording, original plates for magnetic recording, original plates for colored image recording and the like. In the present Specification, explanation will follow principally on the application thereof as an original plate for lithography printing.

2. Description of the Prior Art

As thermosensitive recording materials to be used in original plates for lithographic printing, for example, the following types have been known;

1. Presensitized (PS) Plate having a constitution wherein the surface of an aluminium plate is processed with graining and a thermosensitive layer is arranged thereon;

2. an original plate having a constitution wherein a photoconductive layer comprising zinc oxide and the like is arranged on a support such as paper; and 3. a directly imaging master having a constitution wherein the surface of a support is processed with a hydrophilic process.

Any of these original plates has the surface processed with a hydrophilic process, and can be engraved by depositing an ink-philic substance on the part corresponding to an image. At printing, a hydrophilic non-image part repels oily ink via dampening water, while an ink-philic image part receives oily ink because dampening water is not deposited on that part, whereby the image part and the non-image part are separately obtained thereby achieving lithographic imaging.

However, the discrepancy between so-called ink-philic and hydrophilic properties at the image part and non-image part is slight, so the volume of dampening water has great influence such that when there is a small excess of dampening water, the dampening water remains at the ink-philic image part which may therefore eventually repel oily ink. On the contrary, if there is a small deficiency of dampening water, the repulsion of oily ink from the non-image part is reduced thereby inducing problems such as the occurrence of greasing.

To overcome these problems, proposition has been made of water-less lithographic printing with no use of water (see, for example, Japanese Patent Laid-open Nos. 59-194895, 53-59508, 5369704 and 59-211051). For these original plates for lithographic printing processing machines exclusively for such original plates are required, a special developing process is required, and printing sharpness is poor.

The so-called direct processing technique has been known which can finish direct printing plates based on the information of computer imaging. The direct-processing technique is illustrated by those types using electrophotography for transcription, an etching type, a type employing a photosensitive mechanism via silver salts, and a type using photopolymers or the like. However, these methods comprise forming an image via light, and generating a printing plate through a wet process such as development, fixing, solubilization, hydrophilic process and the like. Thus, problems for these types are as follows;

1. a printing machine of itself should be of a larger type;

2. hands may be contaminated during the handling of chemical reagents such as developing solution, solubilizing solution, etching solution and the like; and 3. liquid waste is generated.

Thus, these methods are not suitable for use in offices.

Furthermore, it cannot be said that the printing plates prepared by these methods are suitable for printing without dampening water, although the plates may be suitable for general printing using dampening water.

SUMMARY OF THE INVENTION

Under these circumstances, the present inventors have made investigations so as to provide an original plate for lithographic printing, capable of supplying a lithographic printing plate which can be directly engraved with no use of ink ribbon or the like and without requiring a wet process such as development, fixing, solubilization, a hydrophilic process or the like, and which can effect printing at a greater sharpness without dampening water.

Consequently, the inventors have found that a printing image can be formed in a simple manner without requiring complex wetting processes or the like as described above, by a process comprising forming an ink-philic resin layer as a first thermosensitive layer on a substrate, forming an ink-repelling layer as a second thermosensitive layer thereon, furthermore forming a coating film layer thereon, subsequently effecting thermosensitive process of a pattern corresponding to the printing image over the laminate, thereafter removing the ink-repelling resin layer corresponding to the thermosensitively processed part together with the coating film, thereby exposing the ink-philic resin layer on the surface layer, whereby the thermosensitively non-processed part can be rendered ink-repelling and the thermosensitively processed part can be rendered ink-philic.

So as to form a sharp printing image through the process, it is required that the thermosensitively processed part and the thermosensitively non-processed part should keep sharp the border from each other in peeling off and removing the ink-repelling resin layer together with the coating film after such thermosensitive process. The present inventors have found, however, that printing images may not be sharp in those structures having a constitution wherein an ink-repelling resin layer and an ink-philic resin layer are composed of simple resins because such peeling cannot be sharply done at the border between the thermosensitively processed part and the thermosensitively non-processed part.

With no limitation to the formation of thermosensitive images using a laminate comprising an ink-philic resin layer, an ink-repelling resin layer and a coating film, such phenomenon may be observed also in the following cases;

1. electrostatic recording through a thermosensitive recording process in the same manner as described above, employing a laminate comprising a conductive resin layer, an insulating resin layer and a coating film;

2. magnetic recording through a thermosensitive recording process in the same manner as described above, employing a laminate comprising a magnetic resin layer, a non-magnetic resin layer and a coating film;

3. image recording process in the same manner as described above, employing a laminate comprising a colored resin layer, a non-colored resin layer or a differently colored resin layer and a coating film; and the like.

Focusing attention to the problems described above, the present invention has been achieved. It is the objective of the present invention to provide a thermosensitive recording material of a type produced by effecting thermosensitive processing of a thermosensitive material of a trilayer structure including a coating film, thereafter peeling off and removing a thermosensitive resin layer on the upper layer together with the coating film, thereby exposing a thermosensitive resin layer on the lower layer for completion of recording, wherein the thermosensitive resin layer on the surface should be peeled off and removed together with the coating film while keeping sharp the border between the thermosensitively processed part and thermosensitively non-processed part, thereby achieving recording at a greater sharpness and a higher precision; and to provide a thermosensitive recording method using the same.

DISCLOSURE OF THE INVENTION

The thermosensitive recording material which has overcome the problems described above, in accordance with the present invention, is summarized as a material having a constitution comprising a recording layer formed on a substrate and a coating film formed thereon, wherein the recording layer is composed of a bilayer structure of a first thermosensitive layer on the lower layer side and a second thermosensitive layer on the upper layer side and particles are dispersed in at least one of the first and second thermosensitive layers.

In this thermosensitive recording material, recording is done by peeling off and removing the second thermosensitive layer at the thermosensitively processed part together with a part of the first thermosensitive layer, thereby exposing the first thermosensitive layer while leaving the second thermosensitive layer on the thermosensitively non-processed part as it is. Preferably, the thermosensitive recording material has laminate strength properties such that, the interfacing peeling strength between the second thermosensitive layer and the coating film layer is small prior to thermosensitive processing and the interfacing peeling strength is then relatively increased at the processed part of the thermosensitive recording material due to the thermosensitive process while the cohesive failure strength in the first thermosensitive layer at the processed part is reduced, so as to keep sharp the border between the thermosensitively processed part and the thermosensitively non-processed part, that occurs when peeling and removing the second thermosensitive layer, at the thermosensitively processed part, and in order to prevent the compositional material of the second thermosensitive material from not peeling.

As the particles to be dispersed in the first thermosensitive layer and/or second thermosensitive layer, preference is given to thermoplastic organic resin particles, preferably of a particle range of 0.001 to 50 μm, wherein the ratio of the particles to the matrix in the first and/or second thermosensitive layer is preferably in a range of 0.01 to 10 parts by weight of the matrix to 1 part by weight of the particles. A polyolefin resin film is the most appropriate as the coating film, and on the surface of the coating film is preferably formed a coating layer containing a heat-resistant lubricating agent.

For use of the thermosensitive recording material of the present invention as an original plate for lithographic printing, the first thermosensitive layer should be an ink-philic resin layer and the second thermosensitive layer should be an ink-repelling layer; the contact angle $\theta$ of the ink-repelling resin layer to linseed oil should be 40 degrees or more, while the contact angle $\theta$ of the ink-philic resin layer to linseed oil should be less than 40 degrees; and the difference in contact angle $\theta$ between the two should be 10 degrees or more, whereby the performance of the material can be made extremely excellent. In case of using the material as an original plate for lithographic printing, the particles to be dispersed in the ink-philic resin layer should be ink-philic particles, while the particles to be dispersed in the ink-repelling resin layer should be ink-repelling particles, preferably. As the matrix material in the ink-repelling resin layer, preference is given to those containing a silicon containing polymer as the principal component or those containing waxes and a synthetic resin as the principal components.

Such thermosensitive recording material can then be applied extensively as follows;

1. an original plate for lithographic printing with the use of an aqueous ink or an oily ink, wherein the first thermosensitive layer is an ink-philic resin layer and the second thermosensitive layer is an ink-repelling resin layer; otherwise, the first thermosensitive layer is an ink-repelling resin layer and the second thermosensitive layer is an ink-philic resin layer;

2. an original plate for recording for use in electrostatic recording, wherein the first thermosensitive layer is a conductive resin layer and the second thermosensitive layer is an insulating resin layer; otherwise, the first thermosensitive layer is an insulating resin layer and the second thermosensitive layer is a conductive resin layer.

3. an original plate for use in OHP or colored image recording, wherein the first thermosensitive layer is a resin layer without containing a dye or a pigment and the second thermosensitive layer is a resin layer containing a dye or a pigment; otherwise, the first thermosensitive layer is a resin layer containing a dye or a pigment and the second thermosensitive layer is a resin layer containing a dye or a pigment of different colors and/or concentrations from those in the first thermosensitive layer; and 4. an original plate for use in magnetic recording, wherein the first thermosensitive layer is a magnetic resin layer and the second thermosensitive layer is a magnetically shielding resin layer; otherwise, the first thermosensitive layer is a non-magnetic resin layer and the second thermosensitive layer is a magnetic resin layer.

By using these thermosensitive recording materials, the coating film layer is drawn and peeled off after the recording part is heated under pressure from the side of the coating film layer and/or the substrate while cohesive failure is simultaneously triggered in the part heated under pressure in the first thermosensitive layer, and thereafter a part of the first thermosensitive layer at the part heated under pressure and the second thermosensitive layer are removed together with the coating film layer. Thus, only the second thermosensitive layer at the thermosensitively processed part can be peeled off and removed sharply together with the coating film, thereby achieving thermosensitive recording at a greater sharpness and a higher precision.

DETAILED DESCRIPTION OF THE INVENTION

Explanation will follow about the constitution of the thermosensitive recording material of the present invention, principally for the representative application example of the material as an original plate for lithographic printing.

Figure 1:
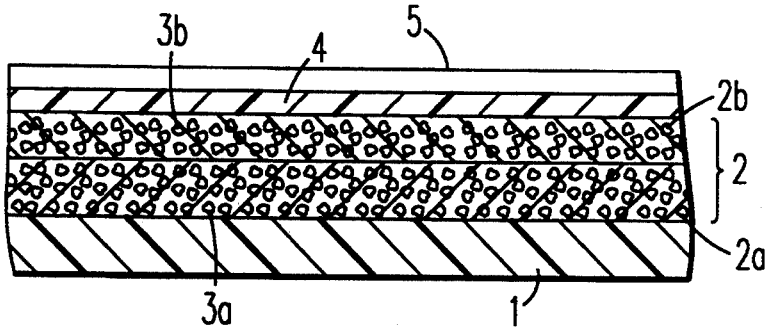
FIG. 1 is an enlarged explanatory view illustrating the cross sectional structure of an original plate for lithographic printing, as a representative example of the thermosensitive recording material of the present invention.

The fundamental structure of the original plate for lithographic printing, in accordance with the present invention, is shown in FIG. 1. In the FIG. 1, 1 represents substrate; 2 represents image recording layer; 2*a* represents ink-philic resin layer; 2*b* represents ink-repelling resin layer; 3*a*, 3*b* represent particles; and 4 represents coating film. Explanation will follow, hereinbelow, of an original plate for lithographic printing with the use of an oily ink wherein the first thermosensitive layer 2*a* is an ink-philic resin layer and the second thermosensitive layer 2*b* is an ink-repelling resin layer.

Figure 2:
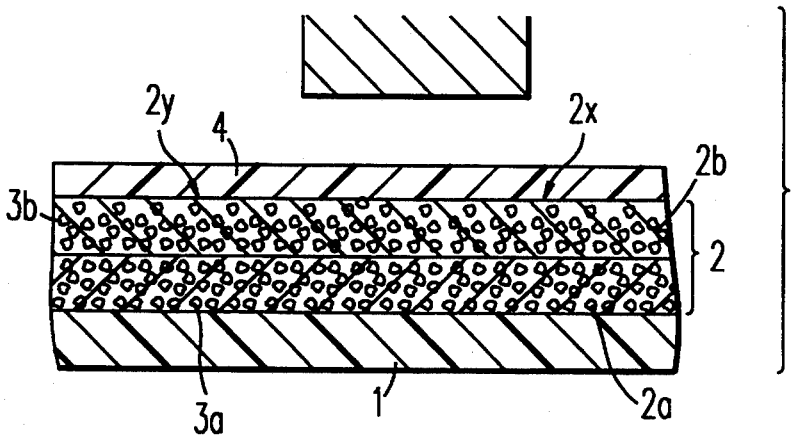
FIG. 2 is an enlarged explanatory view of the cross section depicting the image recording state wherein the thermosensitive recording material of the present invention is used.
Figure 3:
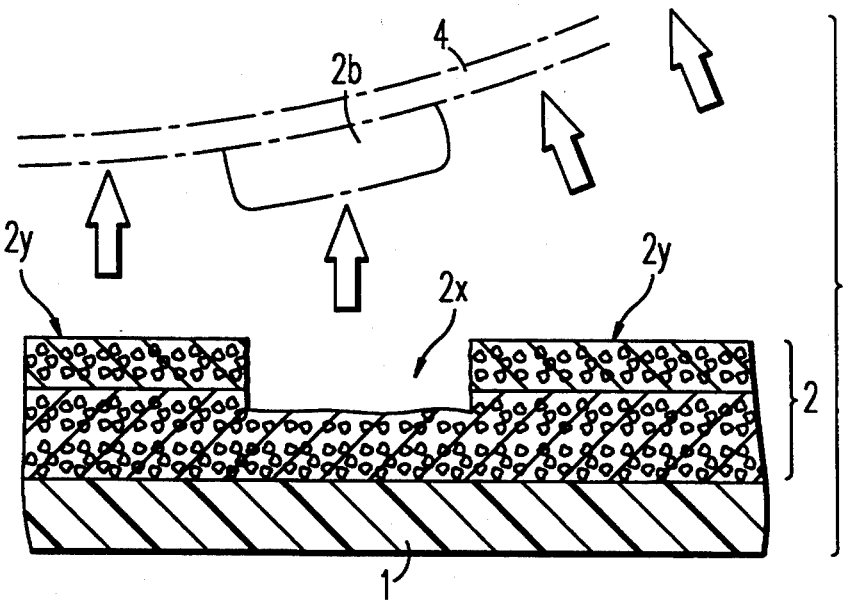
FIG. 3 is an enlarged explanatory view of the cross section depicting the state after the thermosensitive recording material of the present invention is used for image recording.

The original plate is obtained by forming the image recording layer 2 produced by forming the ink-philic resin layer 2*a* and ink-repelling resin layer 2*b* in a laminate form and further laminating the coating film 4 thereon, wherein the particles 3*a*, 3*b* are dispersed in either one or both of the ink-philic resin layer 2*a* and the ink-repelling resin layer 2*b* (the illustrated figure depicts the case of the both). In image processing, by giving heat, heat and pressure, or electric discharge energy in the form of a pattern corresponding to a printing image, from the side of the upper face of the coating film 4 as shown in FIG. 2 (or from the back face of the substrate 1) and then applying heat and the like to the image recording part 2*x* of the image recording layer 2, the ink-repelling resin layer 2*b* at the part is softened or melted, resulting in the increase of the adhesion strength to the coating film 4. Then, the thermally processed part of the ink-repelling resin layer is peeled off and removed along with the coating film 4 as shown in FIG. 3.

The ink-repelling resin layer 2*b* is subsequently removed at the image recording part 2*x*, so that the ink-philic resin layer 2*a* on the side of the lower layer is thereby exposed. Because no heat or the like is applied to the non-image part 2*y*, the ink-repelling resin layer 2*b* at the part 2*y* is not softened or melted, so that only the coating film 4 at the part 2*y* is peeled off and removed at the part 2*y*. Consequently, at the image recording part in the image recording layer 2 after the peeling and removal of the coating film 4 as shown in FIG. 3, the ink-philic resin layer 2*a* is exposed on the surface to constitute an ink receiving part, while the ink-repelling resin layer 2*b* remains as it is, constituting an ink-repelling part.

As has been described above, the present invention provides an original plate for lithographic printing of a peeling-removal type wherein the ink-repelling resin layer 2*b* at the image recording part is peeled off and removed along with the coating film 4 after image processing, thereby exposing the ink-philic resin layer 2*a*. The original plate is of a specific constitution such that particles are dispersed in either one or both of the ink-philic resin layer 2*a* and the ink-repelling resin layer 2*b*, whereby the border between the image recording part and the non-image recording part can be sharply defined, and hence the generation of sharp printing images is accomplished without dampening water.

If particles are dispersed inside of the ink-repelling resin layer 2*b*, the cohesive failure of the resin layer 2*b* at the border between the image recording part 2*x* and the non-image recording part 2*y* is promoted, whereby the image recording part 2*x* is extremely readily peeled off and removed at the ink-repelling resin layer 2*b*. Simultaneously, the image recording part 2*x* and the non-image recording part 2*y* are clearly separated at their border, which is defined by the image processing pattern. Furthermore, the particles dispersed in the non-image part are partially exposed to the surface thereof, thereby suppressing the adhesion of the coating film 4 to the ink-repelling resin layer 2*b*, whereat the promotional effect on peeling the coating film 4 from the ink-repelling resin layer 2*b* is exhibited.

If the particles are dispersed in the inside of the ink-philic resin layer 2*a*, promotion is effected via the particles dispersed as foreign matters, of the cohesive failure of the ink-philic resin layer 2*a* at the border of the image recording part 2*x* and the non-image recording part 2*y* and of the cohesive failure at the interface of the ink-philic resin layer 2*a* and the ink-repelling resin layer 2*b*. In peeling and removing the ink-repelling resin layer 2*b*, where there is increased adhesion strength to the coating film 4, the complete peeling and removal of the ink-philic resin layer 2*a* and the ink-repelling resin 2*b* can be done readily, thereby sharply defining the border of the image recording part 2*x* and non-image recording part, depending on the image processing pattern.

As the substrate to be used in accordance with the present invention, there may be used a plate, sheet or film of metal such as aluminum, soft steel, copper, stainless steel, zinc, etc.; a plate, sheet or film of plastics such as polyester resin, polyethylene resin, polyvinyl chloride resin, polyamide resin, etc.; paper, synthetic paper, paper or synthetic paper coated or laminated with the resins described above, paper or plastic plate, plastic sheet or plastic film or the like, laminated or deposited with the metals described above.

The compositional material of the ink-repelling resin layer 2*b* may be any of those capable of providing an ensured ink-repelling property to the non-image part, including a material which can block greasing of a non-image part and increase the number of printed matters and which concurrently can soften and melt an image recording part via heat or the like, whereby the image recording part can be peeled off and removed along with surface coating film 4. Such material may be illustrated by silicon containing polymers such as silicon resin, silicon acrylic resin, silicon epoxy resin, silicon alkyd resin, silicon urethane resin, modified silicon resin, silicon graft resin, etc.; and fluorine-containing polymers such as tetrafluoroethylene resin, tetrafluoroethylene perfluoroalkyl vinylether copolymer resin, tetrafluoroethylene-ethylene copolymer resin, polyterfluoroethylene chloride, polyfluorovinylidene resin, polymers or copolymers or the like of fluorine containing acrylate derivatives or methacrylate derivatives. Of these, preference is given particularly to silicon containing polymers.

The ink-repelling resin layer *2b* is preferably thinner from the viewpoint of increasing thermal sensitivity and resolution at engraving. However, if it is too thin, the printing resistance thereof gets poor at engraving. Therefore, the balance of the two and the properties of raw material resins should be taken into account to appropriately select the thickness of the resin layer *2b*. However, the standard thickness is in a range of 0.01 to 50 μm, preferably in a range of 0.1 to 20 μm.

The compositional material of the ink-philic resin layer *2a* may not be specifically limited, if the material has ink-philic property. From the viewpoint to acquire image receiving property, resolution, printing resistance and the like, however, preference is given, for example, to waxes such as paraffin wax, microcrystalline wax, bees wax, whale wax, ceramic wax, carnauba wax, candela wax, montan wax, low-molecular polyethylene wax, polypropylene wax, stearamide, linolenamide, laurylamide, myristylamide, methylene bis-stearamide, ethylene bis-stearamide; ink-philic polymers such as styrene resin, acrylic resin, methacrylic resin, acrylonitrile resin, amino resin, coumarone-indene resin, rosin modified phenol resin, terpene modified phenol resin, urethane resin, xylene resin, ketone resin, etc., singly or in combination of two or more thereof in the form of copolymers, individually modified products thereof or a mixture of two or more thereof. Among them, a mixture of wax with a single synthetic resin or a copolymer such as styrene resin, acrylic resin, methacrylic resin, acrylonitrile resin, amino resin, coumarone-indene resin, rosin modified phenol resin, terpene modified phenol resin, urethane resin, xylene resin, ketone resin, etc.. The thickness of the ink-philic resin layer *2a* is preferably in a range of 0.5 to 20 μm, more preferably in a range of 1 to 10 μm.

The preferable compositional materials of the ink-philic resin layer *2a* and the ink-repelling resin layer *2b* constituting the image recording layer in accordance with the present invention have been described insofar. From the viewpoint of increasing the resolution of printing images, materials should be selected on the basis of the standard criteria for the ink-philicity and ink-repelling property, "contact angle ($\theta$) to linseed oil", for example, 40 degrees or less for the $\theta$ of ink-philicity and 40 degrees or more for the $\theta$ of the ink-repelling property. A combination of an ink-philic resin and an ink-repelling resin with the difference in contact angle $\theta$ of 10 degrees or more, should be selected for use.

As the particles to be dispersed in the ink-philic resin layer *2a* and/or the ink-repelling resin layer *2b*, various particles may be used whether or not they are organic particles (including thermoplastic particles or heat resistant, cross linked particles) or inorganic particles, including waxes such as paraffin wax, microcrystalline wax, bees wax, whale wax, ceramic wax, carnauba wax, candela wax, montan wax, low-molecular polyethylene wax, polypropylene wax, stearamide, linolenamide, laurylamide, myristylamide, methylene bis-stearamide, ethylene bis-stearamide; styrene resin, acrylic resin, methacrylic resin, acrylonitrile resin, amino resin, coumarone-indene resin, rosin modified phenol resin, terpene modified phenol resin, urethane resin, xylene resin, ketone resin, etc., singly or in the form of copolymers or mixtures in combination of two or more thereof, organic particles such as cross-linking type particles obtained through modification of the above resins for an increased heat resistance, and inorganic particles such as silica, titanium, zirconia, various salts of heteropolyacids, etc.. Among them, preference is given to organic thermoplastic particles of a single resin or a copolymer resin or a mixture of two or more, selected from styrene resin, acrylic resin, methacrylic resin, acrylonitrile resin, amino resin, coumarone-indene resin, rosin modified phenol resin, terpene, modified phenol resin, urethane resin, xylene resin, ketone resin, silicon containing polymers such as silicon alkyd resin, silicon urethane resin, modified silicon resin, silicon graft resin, etc., tetrafluoroethylene resin, tetrafluoroethylene perfluoroalkyl vinylether copolymer resin, tetrafluoroethylene ethylene copolymer resin, polyterfluoroethylene, polyfluorovinylidene resin, polymers or copolymers of fluorine containing acrylate derivatives or methacrylate derivatives.

In accordance with the present invention, preference is also given to organic coated particles having the surface coated with waxes such as paraffin wax, microcrystalline wax, bees wax, whale wax, ceramic wax, carnauba wax, candela wax, montan wax, low-molecular polyethylene wax, polypropylene wax, stearamide, linolenamide, laurylamide, myristylamide, methylene bis-stearamide, ethylene bis-stearamide, styrene resin, acrylic resin, methacrylic resin, acrylonitrile resin, amino resin, coumarone-indene resin, rosin modified phenol resin, terpene modified phenol resin, urethane resin, xylene resin, ketone resin, etc., silicon containing polymers such as silicon resin, silicon acrylic resin, silicon epoxy resin, silicon alkyd resin, silicon urethane resin, modified silicon resin, silicon graft resin, etc., tetrafluoroethylene resin, tetrafluoroethylene perfluoroalkyl vinylether resin copolymer, tetrafluoroethylene ethylene copolymer resin, polyterfluoroethylene, polyfluorovinylidene resin, polymers or copolymers of fluorine containing acrylate derivatives or methacrylate derivatives. In case of using such coated particles, the dispersibility thereof in the inside of the resin layer *2b* can be increased greatly by selecting the type of the coating agent.

The particle size is preferably in a range of 0.001 to 50 μm, more preferably in a range of 0.01 to 20 μm, most preferably in a range of 0.05 to 10 μm.

The particles to be dispersed in the ink-philic resin layer *2a* preferably have the surface of ink-philic property, while the particles dispersed in the ink-repelling resin layer *2b* preferably have the surface of ink-repelling property, because not only the particles can be uniformly dispersed in the inside of each of the resin layers *2a* and *2b*, but also the ink-philic property and ink-repelling property may possibly not be blocked even if the particles are exposed to the surface layer of each of the resin layers *2a* and *2b*, whereby sharper printing images can readily be generated.

In order that the effect on the particle dispersion described above is exhibited efficiently, the ratio of the matrix resin to the particles dispersed in the ink-philic resin layer 2*a* and/or the ink-repelling resin layer 2*b* is in a range of 0.01 to 10, preferably in a range of 0.02 to 5 parts by weight of the matrix to one part by weight of the particles.

The coating film 4 to be formed on the image recording layer has a function to protect the image recording layer 2 in the state of original plate, and also serves as a supporting layer for peeling in order to peel and remove the ink-repelling resin layer 2*b* at the image processing part in producing lithographic plates. As the film compositional material, preference is given, for example, to polyolefin such as polyethylene and polypropylene, polyvinyl chloride, polyvinylidene chloride, polystyrene, ethylene-vinyl acrylate copolymer, ethylenemethacrylate copolymer, ethylene-vinyl acetate copolymer, saponified ethylene-vinyl acetate copolymer, ethylene-α-olefin copolymer elastomer, acid modified polyolefin, styrene-butadiene-acrylonitrile copolymer, polyamide, polycarbonate, polysulfone, polyacetal, polymethyl methacrylate, polyphenylene oxide, polyurethane, polyethylene terephthalate, polybutadiene terephthalate, nylon, polyimide, other plastics, paper such as condenser paper, fabric, non-woven fabric and a single product or mixed product thereof (co-extrusion film), and complex products and laminated products thereof. Of these, polyolefin is the most preferable.

If the heat resistance of the film is insufficient or the slipping potential thereof is insufficient, a heat resistant slip agent 5 of a thickness of about 1 to 2 μm can be effectively coated onto the film. Into the layer can be mixed a heat resistant resin of a three-dimensional structure, such as acrylic resin and the like, together with a slip agent such as microsilica and the like.

The compositional material of the coating film layer 4 is appropriately determined depending on the compositional material of the ink-repelling resin layer 2*a*. In the selection, preference is given to a combination of materials which can be readily peeled off from a non-image processing part and can intensely bond to the softened and melted ink-repelling resin layer 2*b* on an image processing part, thereby achieving the peeling and removal of the part.

In accordance with the present invention as has been described above, an image corresponding to a thermosensitively processing pattern can be formed by peeling and removing the second thermosensitive layer (ink-repelling resin layer 2*b*) at the thermosensitively processed part together with coating film 4 via the peeling after the thermosensitive process, thereby exposing the first thermosensitive layer (ink-philic resin layer 2*a*) on the surface, and peeling and removing, at the thermosensitively non-processed part, only the coating film 4 while leaving the second thermosensitive layer (ink-repelling resin layer 2*b*) as it is. In order to realize such image processing, compositional materials should be selected so as to exhibit a laminate adhesion strength and a laminate cohesive failure strength such that the strength property inside a laminate of a tetralayer structure composed of substrate/first thermosensitive layer/second thermosensitive layer/coating film should meet the following requirements.

That is, when the laminate adhesion strength between a substrate and a first thermosensitive layer is designated as A; the laminate cohesive failure strength in the first thermosensitive layer is designated as B; the laminate adhesion strength between the first thermosensitive layer and the second thermosensitive layer is designated as C; the cohesive failure strength in the second thermosensitive layer is designated as D; and the laminate adhesion strength between the second thermosensitive layer and the coating film is designated as E, the laminate strength properties should be provided such as those described below;

1. the above-mentioned strength E should be at minimum in the state without thermosensitive process; and 2. the above-mentioned laminate peeling strength E should get a relative increase via the thermosensitive process at a thermosensitively processed part, resulting in the strength B at minimum.

With such laminate strength properties if provided, interfacing peeling between the coating film and the second thermosensitive layer occurs at a thermosensitively non-processed part, via the strength properties described above in 1, whereby the second thermosensitive layer is exposed on the surface, in peeling the coating film after the thermosensitive processing; while at a thermosensitively processed part, cohesive failure occurs inside the first thermosensitive layer via the strength property described in 2, involving the peeling and removal of the second thermosensitive layer along with a part of the first thermosensitive layer and together with the coating film, whereby the first thermosensitive layer is exposed onto the surface.

Because the thermosensitive process for image recording is generally effected via heating under pressure from the side of the coating film on the uppermost surface layer, the increase in the laminate adhesion strength between the coating film and the second thermosensitive layer reaches highest via the thermosensitive process; on the contrary, the cohesive failure strength inside the first thermosensitive layer in the greatest depth is exposed to minimum influence of the thermosensitive process, so that the strength rarely is enhanced after the thermosensitive process. Thus, the laminate strength properties described above in 1 and 2, can relatively readily be ensured, by appropriately selecting a combination of the individual compositional materials.

The above explanation has been done about the process of producing an original plate for producing a plate for lithographic printing with the use of oily inks, comprising making a combination of an ink-philic resin layer as a first thermosensitive layer and an ink-repelling resin layer as a second thermosensitive layer. Now, the explanation will also be applicable to the case using aqueous inks and magnetic inks. Also, production is possible of a thermosensitive recording material providing an original plate for lithographic printing of an inversion type with no ink deposition at a thermosensitively processed part, if preparing a laminate structure comprising a combination of an ink-repelling resin layer as a first thermosensitive, layer and an ink-philic resin layer as a second resin layer, removing the ink-repelling resin layer at a thermosensitively processed part via the peeling of a coating film after the thermosensitive process, thereby exposing the ink-philic resin layer onto the surface.

Following the same discipline, a variety of thermosensitive recording materials can be produced for use in electrostatic recording, magnetic recording or image recording or the like, by the following various modifications of the compositional materials of a first thermosensitive layer and a second thermosensitive layer.

That is, a thermosensitive recording material for electrostatic recording can be produced through a process comprising making a combination of a conductive resin layer as a first thermosensitive layer and an insulating resin layer as a second thermosensitive layer or a combination of an insulating layer as a first thermosensitive layer and a conductive resin layer as a second thermosensitive layer, peeling and removing the insulating resin layer or the conductive resin layer at a thermosensitively "processed part together with the coating film, thereby exposing the conductive resin layer or the insulating resin layer at the thermosensitively processed part on the surface.

The conductive resin to be used herein preferably includes, for example, polyanilines, polythiophenes, polyacetylenes, polypyrroles, or polymers containing quartary ammonium salt such as dimethylaminoethyl methacrylate chloride, dimethylaminoethyl acrylate chloride, and the like; the insulating resin includes copolymers of a single or two or more of polymers for example, styrene resin, acrylic resin, methacrylic resin, acrylonitrile resin, amino resin, coumarone,indene resin, rosin modified phenol resin, terpene modified phenol resin, urethane resin, xylene resin, ketone resin; modified products thereof, or mixtures of two or more of them.

A thermosensitive recording material for magnetic recording can be produced through a process comprising making a combination of a magnetic resin layer as a first thermosensitive layer and a magnetically shielding resin layer as a second thermosensitive layer or a combination of a non-magnetic resin layer as a first thermosensitive layer and a magnetic resin layer as a second thermosensitive layer, peeling and removing the second thermosensitive layer at a thermosensitively processed part together with the coating film, thereby exposing the first thermosensitive layer at the thermosensitively processed part on the surface.

Magnetic particles in dispersion in a variety of resins illustrated as the compositional resins for original plates for lithographic printing may be employed as the compositional material of such magnetic resin layer, including for example magnetic powders of oxides such as $\gamma$-$Fe_2O_3$ powder, $Fe_3O_4$ powder, Co containing $\gamma$-$Fe_2O_3$ powder, Co containing $Fe_3O_4$ powder, hexagonal ferrite powders such as barium ferrite, strontium ferrite and the like, or metal powders such as Fe powder, Co powder, Fe-Ni powder and the like.

The compositional material of the non-magnetic resin layer includes polymers such as styrene resin, acrylic resin, methacrylic resin, acrytonitrile resin, amino resin, coumaroneindene resin, rosin modified phenol resin, terpene modified phenol resin, urethane resin, xylene resin, ketone resin and the like; copolymers of two or more thereof, or various modified products thereof, or mixtures of two or more thereof. As the compositional material for the magnetically shielding layer, use can be made of the various resins illustrated above as the compositional materials of the non-magnetic resin layer, the copolymer resins thereof, or various modified products and mixtures thereof; additionally, use can also be made of magnetically shielding powdery metals, such as nickel, chromium, manganese, copper and the like, and the oxide powders of such metals in dispersion and the like.

Making a combination of a resin layer without containing a dye or a pigment as a first thermosensitive layer and a resin layer containing a dye or a pigment as a second thermosensitive layer or a combination of a resin layer containing a dye or a pigment and a resin layer containing a dye or a pigment of different colors or different concentrations from those in the first thermosensitive layer, peeling and removing the second thermosensitive layer at a thermosensitively processed part together with the coating film, thereby exposing the first thermosensitive layer at the thermosensitively processed part onto the surface, there is formed a colored image exactly corresponding to the very pattern for thermosensitive process via the peeling of the coating film after the thermosensitive process. Thus, such combination can be employed as a thermosensitive recording material for colored image formation.

If a substrate and a first thermosensitive layer are prepared from optically transmitting materials and a second layer is prepared from an optically non-transmitting material, the part remaining after the second thermosensitive layer on a photosensitively processed part is removed, can singly be rendered optically transmitting via image processing. Thus, such preparation can be applicable as an original plate for lithographic printing.

Any type of dyes and pigments capable of coloring the base resin constituting each thermosensitive layer can be employed, and use may satisfactorily be made of natural or synthetic dyes such as dispersion dyes, cation dyes, acid dyes and the like; inorganic pigments such as titanium dioxide, silica, ferrous oxide, rouge and the like; organic pigments such as spherical particles composed of various resins, carbon black, indanthrone blue, thioindigo red, isoindolinone yellow, various phthalocyanines and the like.

The process thus constituted for producing the compositional materials for thermosensitive recording is without specific limitation, but general methods therefor comprise coating onto a substrate a first thermosensitive layer constituting resin with particles in dispersion as it is or after it is diluted with an appropriate solvent if necessary, drying the resin, coating subsequently a second thermosensitive layer constituting resin with particles in dispersion thereon, after it is diluted with an appropriate solvent if necessary, followed by drying. For such coating, use may be made of applicators, spray coaters, bar coaters, dip coaters, spin coaters, doctor blades and the like; the drying after the coating should be done by heating in hot air at 30° to 80° C. for 30 minutes or more.

Finally, illustration will follow of an adhesion method of a coating film. The term "adhesion" herein refers to the procedure comprising overlaying a coating film onto a thermosensitive recording layer, additionally including, the case of interposing an adhesive having a peeling function between the two sheets or of integrally bonding the two sheets together or a method for preparing a coating film comprising coating an adhesive on the surface of a plate into a film. As has been described above in accordance with the present invention, the particles may satisfactorily be dispersed in at least either one of the first thermosensitive layer and the second thermosensitive layer. It is preferred that the particles are dispersed at least in the first thermosensitive layer because the effect may be exhibited in a more reliable manner.

In applying the thermosensitive recording process to the thermosensitive recording material, heat, heat under pressure, or discharge energy is given to a part corresponding to a printing image from the side of the surface, back surface or both surfaces of the image recording layer, while heat or the like is applied only to the image recording part, whereby the interfacing adhesion strength between the second thermosensitive layer on the recording part and the coating film is relatively increased while making minimum the cohesive failure strength inside the first thermosensitive layer. By peeling off and removing the coating film, then, the second thermosensitive layer at the thermosensitive recording part is peeled and removed, accompanying a part of the first thermosensitive layer below the second thermosensitive layer.

Consequently, the first thermosensitive layer is exposed at the thermosensitively processed part, while on the surface of the thermosensitively non-processed part, the second thermosensitive layer is left as it is. Hence, a recording plate can be produced, wherein the first thermosensitive layer is distinctively separated from the second thermosensitive layer which pattern corresponds to the recording pattern.

The energy to be used for the recording process may, without any specific limitation, be those which do not greatly increase the cohesive failure strength in the first thermosensitive layer but relatively increase the interfacing adhesion strength between the second thermosensitive layer and the coating film, thereby peeling and removing the second thermosensitive layer at the thermosensitively processed part together with the coating film. Generally, methods by means of heat, heat and pressure or discharge energy are employed.

The method employing heat includes, for example, a method comprising heating with a thermal head which has been remarkably common in recent years in facsimiles and printers, a method using a hot pen, a method comprising pressing a mold, a method comprising irradiating laser beam thereby effecting heating, a method comprising irradiating flush beam thereby effecting heating, a method comprising heating with the irradiation of ultraviolet ray, electron beam, high-frequency wave, and other electromagnetic wave.

In terms of sensitivity and operability, in particular, preference is given to a method comprising heating with a thermal head or a method comprising irradiating laser beam thereby effecting heating. As such thermal head, thermal heads for use in commercially available thermal facsimiles and thermal printers may be applicable, while as the laser beam, there may be illustrated semiconductor laser, helium neon laser, argon laser, krypton laser, helium cadmium laser, carbon dioxide gas laser, excimer laser, ruby laser, glass laser, YAG laser, dye laser and the like. In case of using laser, it is preferred that a laser sensitive dye or photothermal-conversion substances such as carbon black may be contained in the particles in the image recording layer.

With no limitation to a specific temperature, the heating temperature may generally be 50° to 400° C., preferably 60° to 300° C. If the heating temperature is lower, the sensitivity is decreased; if the heating temperature is higher, the surface coating film, the ink-philic resin layer or substrate materials possibly may be modified or damaged. The heating time period is preferably 0.1 millisecond to 100 milliseconds, more preferably 0.5 millisecond to 20 milliseconds when a thermal heat is used. The exposure time is preferably 0.5 nanosecond to 1 second, more preferably 1 nanosecond to 1 millisecond per spot, when laser is used. If the heating time is shorter, the resolution gets insufficient; if the heating time is longer, a prolonged period of time may be required for the processing.

When heating under pressure is employed, the method using a thermal head or a hot pen or the method comprising pressing a pixel-like mold or the like may be applicable.

The method using electric discharge is illustrated, for example, by a method comprising applying a voltage to a pin electrode or the like following image information through scanning, and recording an image part onto a plate material. From the viewpoint of resolution, the applied voltage then is preferably about 60 to 80 V, and the recording speed is preferably 1 to 10 cm/second.

DESCRIPTION OF PREFERRED EMBODIMENT

EXAMPLE 1

An aqueous styrene-acrylic paint ("Acryset EMN-190E", manufactured by Nippon Shokubai, Co. Ltd.) (5 g as non-volatile component-converted value) and a styrene-butyl acrylate copolymer in particles of an average particle size of 0.2 μm (10 g; manufactured by Nippon Shokubai, Co Ltd.) were dispersed by means of a paint shaker for 2 hours. The dispersion solution was coated onto a polyester film (substrate) of a thickness of 0.2 mm so that the final dry thickness might be 5 μm, followed by drying in hot air at 80° C. for 2 hours, thereby forming an ink-philic resin layer (first thermosensitive layer) with the particles dispersed therein.

The liquid droplets of 4 μl of linseed oil (manufactured by WAKO Chemicals, Co. Ltd.; reagent grade 1) were applied to the surface of the resin layer, and the contact angle $\theta$ of the liquid droplets to the resin layer was measured with an automatic contact angle meter (Type "CA-Z", manufactured by Kyowa Interface Science, Co. Ltd.). The $\theta$ was 14 degrees.

A fluorine paint ("GF-300", manufactured by Toa Synthetic Chemicals, Co. Ltd.) (5 g as non-volatile component-converted value) and a styrene-butyl acrylate copolymer in particles of an average particle size of 0.2 μm (10 g; manufactured by Nippon Shokubai, Co. Ltd.) were dispersed by means of a paint shaker for 2 hours. The dispersion solution was coated onto the ink-philic resin layer to a final dry thickness of 0.5 μm, followed by drying in hot air at 50° C. for 2 hours, thereby forming an ink-repelling resin layer (second thermosensitive layer) with the particles dispersed therein.

The liquid droplets of 4 μl of linseed oil (manufactured by WAKO Chemicals, Co. Ltd.; reagent grade 1) were applied to the surface of the resin layer, and the contact angle $\theta$ was measured as described above. The $\theta$ was 67 degrees.

A polyethylene film of a thickness of 30 μm was charged onto the resin layer thus obtained, which was then rubbed with a heating roll at 50° to 60° C. for adhesion, to produce an original plate for lithographic printing. After a thermal printing process with a thermal facsimile (Panafax UF-83) was effected on the original plate for lithographic printing, the polyethylene film on the surface was peeled off. Thus, the ink-repelling resin layer (second thermosensitive layer) at the printing part was peeled off and removed along with the film, whereby the ink-philic resin layer (first thermosensitive layer) on the lower layer was exposed to produce a lithographic printing plate.

By using the printing plate, printing was done with an offset printing machine (manufactured by Gestatener, Co. Ltd.) without using dampening water. Thus, printed matters with sharp images were still obtained even after printing about 3,000 sheets of printed matters.

EXAMPLE 2

Except for skipping the process of dispersing particles in an ink-philic resin layer (first thermosensitive layer), the same procedures as in Example 1 were carried out to produce an original plate for lithographic printing. The contact angle of the surface of the ink-philic resin layer to linseed oil was 15 degrees, while the contact angle $\theta$ of the surface of the ink-repelling resin layer to linseed oil was 67 degrees. Following the same procedures as in Example 1, the thermal printing process with a thermal facsimile, the peeling and removal of the ink-repelling resin layer (second thermosensitive, layer) on the printing part, and the printing test without dampening water were effected. Then, printed matters with sharp images were still obtained even after printing about 3,000 sheets of printed matters.

EXAMPLE 3

Except that the fluorine paint in the ink-repelling resin layer (second thermosensitive layer) was replaced with a silicon paint ("GS-30", manufactured by Toa Synthetic Chemical Industry, Co. Ltd.), the same procedures as in Example 1 were carried out to produce an original plate for lithographic printing. The contact angle $\theta$ of the surface of the ink-philic resin layer (first thermosensitive layer) to linseed oil was 14 degrees, while the contact angle $\theta$ of the surface of the ink-repelling resin layer to linseed oil was 45 degrees. Following the same thermal facsimile, the peeling and removal of the ink-repelling resin layer on the printing part, and the printing test without dampening water were effected. Then, printed matters with sharp images were still obtained even after printing about 3,000 sheets of printed matters.

EXAMPLE 4

Except that the fluorine paint in the ink-repelling resin layer (second thermosensitive layer) was replaced with a silicon rubber paint of a room temperature curing type ("KE42S", manufactured by Shin-etsu Chemical Industry, Co. Ltd.), the same procedures as in Example 1 were carried out to produce an original plate for lithographic printing. The contact angle $\theta$ of the surface of the ink-philic resin layer (first thermosensitive layer) to linseed oil was 14 degrees, while the contact angle $\theta$ of the surface of the ink-repelling resin layer to linseed oil was 43 degrees. Following the same procedures as in Example 1, the thermal printing process with a thermal facsimile, the peeling and removal of the ink-repelling resin layer on the printing part, and the printing test without dampening water were effected. Then, printed matters with sharp images were still obtained even after printing about 3,000 sheets of printed matters.

EXAMPLE 5

Except that the styrene-acrylate butyl copolymer particle in the ink-repelling resin layer (second thermosensitive layer) was replaced with a silica particle of an average particle size of 0.3 $\mu$m (manufactured by Nippon Shokubai, Co. Ltd.) and that coating was done to a final dry thickness of the ink-repelling resin layer of 0.5 $\mu$m, the same procedures as in Example 1 were carried out to produce an original plate for lithographic printing. The contact angle $\theta$ of the surface of the ink-philic resin layer (first thermosensitive layer) to linseed oil was 14 degrees, while the contact angle $\theta$ of the surface of the ink-repelling resin layer to linseed oil was 65 degrees. Following the same procedures as in Example 1, the thermal printing process with a thermal facsimile, the peeling and removal of the ink-repelling resin layer on the printing part, and the printing test without dampening water were effected. Then, printed matters with sharp images were still obtained even after printing about 3,000 sheets of printed matters.

EXAMPLE 6

Thyraplane ("FM-0725", a reactive silicon with an average molecular weight of 10,000; manufactured by Chisso, Co. Ltd.) (25 g), styrene monomer (20 g), butyl acrylate (5 g) and a polymerization initiator (0.5 g; "V-59"; manufactured by WAKO Chemicals, Co. Ltd.) were dissolved in 50 g of normal hexane, and while raising the temperature under agitation, polymerization was effected at the reflux temperature for 20 hours. Thereafter, the normal hexane was distilled off under reduced pressure, followed by dissolution of 5 g of silicon graft polymer (I), 60 g of styrene monomer, 20 g of butyl acrylate, 20 g of divinyl benzene and 0.5 g of a polymerization initiator ("V-59", the same as described above) in 900 g of normal hexane. The temperature was raised under agitation, for polymerization at a reflux temperature for 10 hours. Then, the reaction solution was cooled and centrifuged, and the resulting precipitate was dried in nitrogen stream at 30° C. for 12 hours. A coated particle of 85 g was obtained, by employing the silicon graft polymer (I) as a coating material. The average particle size of the coated particles thus obtained was 0.4 $\mu$m.

Except that the styrene-acrylate butyl copolymer particles in the ink-repelling resin layer (second-thermosensitive layer) were replaced with the coated particles thus synthesized by the method described above, the same procedures as in Example 1 were carried out to produce an original plate for lithographic printing. The contact angle $\theta$ of the surface of the ink-philic resin layer (first thermosensitive layer) to linseed oil was 14 degrees, while the contact angle $\theta$ of the surface of the ink-repelling resin layer to linseed oil was 62 degrees. Following the same procedures as in Example 1, the thermal printing process with a thermal facsimile, the peeling and removal of the ink-repelling resin layer on the printing part, and the printing test without dampening water were effected. Then, printed matters with sharp images were still obtained even after printing about 3,000 sheets of printed matters.

EXAMPLE 7

Except that the styrene-acrylate butyl copolymer particle in the ink-philic resin layer (first thermosensitive layer) was replaced with a benzoguanamine polymer particle of an average particle size of 0.3 $\mu$m (manufactured by Nippon Shokubai, Co. Ltd.), the same procedures as in Example 1 were carried out to produce an original plate for lithographic printing. The contact angle $\theta$ of the surface of the ink-philic resin layer to linseed oil was 15 degrees, while the contact angle $\theta$ of the surface of the ink-repelling resin layer (second thermosensitive layer) to linseed oil was 67 degrees. Following the same procedures as in Example 1, the thermal printing process with a thermal facsimile, the peeling and removal of the ink-repelling resin layer on the printing part, and the printing test without dampening water were effected. Then, printed matters with sharp images were still obtained even after printing about 3,000 sheets of printed matters.

EXAMPLE 8

An aqueous styrene-acrylic paint ("Acryset EMN-190E", manufactured by Nippon Shokubai, Co. Ltd.) (5 g as non-volatile component-converted value), a styrene-butyl acrylate copolymer in particles of an average particle size of 0.2 μm (10 g; manufactured by Nippon Shokubai, Co Ltd.), and carbon black (0.1 g; manufactured by Mitsubishi Chemical Industry, Co. Ltd.) were dispersed by means of a paint shaker for 2 hours. The dispersion solution was coated onto a polyester film (substrate) of a thickness of 0.2 mm to a final dry thickness of 5 μm, followed by drying in hot air at 80° C. for 2 hours, thereby forming an ink-philic resin layer (first thermosensitive layer) with the particles dispersed therein.

The liquid droplets of 4 μl of linseed oil (manufactured by WAKO Chemicals, Co. Ltd.; reagent grade 1) were applied to the surface of the resin layer, and the contact angle θ of the liquid droplets to the resin layer was measured with an automatic contact angle meter (Type "CA-Z", manufactured by Kyowa Interface Science, Co. Ltd.). The θ was 14 degrees.

A fluorine paint ("GF-300", manufactured by Toa Synthetic Chemicals, Co. Ltd.) (5 g as non-volatile component-converted value), a styrene-butyl acrylate copolymer in particles of an average particle size of 0.2 μm (10 g; manufactured by Nippon Shokubai, Co. Ltd.) and carbon black (0.1 g; the same as described above) were dispersed by means of a paint shaker for 2 hours. The dispersion solution was coated onto the ink-philic resin layer to a final dry thickness of 0.5 μm, followed by drying in hot air at 50° C. for 2 hours, thereby forming an ink-repelling resin layer (second thermosensitive layer) with the particles dispersed therein.

The liquid droplets of 4 μl of linseed oil (the same as described above) were applied to the surface of the resin layer, and the contact angle θ was subsequently measured as described above. The θ was 67 degrees.

A polyethylene film of a thickness of 30 μm was charged onto the resin layer thus obtained, which was then rubbed with a heating roll at 50° to 60° C. for adhesion, to produce an original plate for lithographic printing. At a scanning speed of 3 m/s and a scanning pitch of 20 μm, the original plate for lithographic printing was exposed to an image under an argon laser beam of 120 mW collimated into a beam diameter of 25 μm×25 μm at $I/e^2$. After the polyethylene film on the surface was then peeled off, the ink-repelling resin layer (second thermosensitive layer) on the printing part was peeled off and removed along with the film, thereby exposing the ink-philic resin layer (first thermosensitive layer) on the lower layer, to produce a lithographic printing plate.

By using the printing plate, printing was done with an offset printing machine (manufactured by Gestatener, Co. Ltd.) with no use of dampening water. Thus, printed matters with sharp images were still obtained even after printing about 3,000 sheets of printed matters.

EXAMPLE 9

By replacing the argon laser in Example 8 with a pin electrode with 80 V to be imposed onto the original plate for lithographic printing, image formation was done at a recording speed of 8 cm/second and an image density of 32/mm. After the polyethylene film on the surface was then peeled off, the ink-repelling resin layer (second thermosensitive layer) on the printing part was peeled off and removed along with the film, thereby exposing the ink-philic resin layer (first thermosensitive layer) on the lower layer, to produce a lithographic printing plate.

By using the plate, printing was done with an offset printing machine (manufactured by Gestatener, Co. Ltd.) with no use of dampening water. Thus, printed matters with sharp images were still obtained after printing about 3,000 sheets of printed matters.

EXAMPLE 10

A mixture of polyurethane resin (product name of "Super Flex 150"; manufactured by Dai-ichi Pharmaceutical Industry, Co. Ltd.) (1 g as non-volatile component-converted value), and carnauba wax (product name of "Cellosol 524" manufactured by Chukyo Resin Industry, Co. Ltd.) (4 g as non-volatile component-converted value) and a styrene-butyl acrylate polymer in particles of an average particle size of 0.2 μm (10 g; the same as described above) were were dispersed by means of a paint shaker for 2 hours. The dispersion solution was coated onto a 0.2-mm thick polyester film (substrate) to a final dry thickness of 5 μm, followed by drying in hot air at 80° C. for 2 hours, thereby forming an ink-philic resin layer (first thermosensitive layer) with the particles dispersed therein.

The liquid droplets of 4 μl of linseed oil (the same as described above) were applied to the surface of the resin layer, and the contact angle θ of the liquid droplets to the resin layer was measured as described above. The θ was 30 degrees.

A silicon rubber paint of a room temperature curing type (the same as described above; 10 g as a non-volatile component converted value) and a styrene-butyl acrylate copolymer in particles of an average particle size of 0.2 μm (5 g; the same as described above) were dispersed by means of a paint shaker for 2 hours. The dispersion solution was coated onto the above ink-philic resin layer to a final dry thickness of 1.5 μm, followed by drying in hot air at 50° C. for 2 hours, thereby forming an ink-repelling resin layer (second thermosensitive layer) with the particles dispersed therein.

The liquid droplets of 4 μl of linseed oil (the same as described above) were applied to the surface of the resin layer, and the contact angle θ of the liquid droplets to the resin layer was measured as described above. The θ was 45 degrees.

A polyethylene film of a thickness of 30 μm was charged onto the resin layer thus obtained, which was then rubbed with a heating roll at 50° to 60° C. for adhesion, to produce an original plate for lithographic printing. After the original plate for lithographic printing was subjected to thermal printing process with a thermal facsimile, the polyethylene film on the surface was peeled off. Thus, the ink-repelling resin layer (second thermosensitive layer) on the printing part was peeled off and removed along with the film, thereby exposing the ink-philic resin layer (first thermosensitive layer) on the lower layer, to generate a lithographic printing plate.

By using the printing plate, printing was done with an offset printing machine (manufactured by Gestatener, Co. Ltd.) without using dampening water. Thus, printed matters with sharp images were still obtained even after printing about 3,000 sheets of printed matters.

EXAMPLE 11

Except that the polyethylene film as the coating film in Example 10 was replaced with a polypropylene film of a thickness of 30 μm, the same procedures as in Example 10 were followed to obtain an original plate for lithographic printing.

By using the printing original plate, the same procedures as in Example 10 were followed for thermal printing process with a thermal facsimile, the peeling and removal of the ink-philic resin layer (second thermosensitive layer) on the printing part, and the printing test without dampening water. Thus, printed matters with sharp images were still obtained even after printing about 3,000 sheets of printed matters.

EXAMPLE 12

Except that the styrene-acrylate copolymer resin particle to be dispersed in the ink-repelling resin layer (second thermosensitive layer) was replaced with the coated particle synthesized in Example 6, the same procedures as in Example 10 were followed to obtain an original plate for lithographic printing. The contact angle $\theta$ of the surface of the ink-philic resin layer (first thermosensitive layer) to linseed oil was 30 degrees, while the contact angle $\theta$ of the surface of the ink-repelling resin layer to linseed oil was 52 degrees.

By using the printing original plate, the same procedures as in Example 10 were followed for thermal printing process with a thermal facsimile, the peeling and removal of the ink-repelling resin layer (second thermosensitive layer) on the printing part, and the printing test without dampening water. Thus, printed matters with sharp images were still obtained even after printing about 3,000 sheets of printed matters.

EXAMPLE 13

Except that the silicon rubber paint in the ink-repelling resin layer was replaced with the fluorine paint (the same as described above), the same procedures as in Example 10 were followed to obtain an original plate for lithographic printing. The contact angle $\theta$ of the surface of the ink-philic resin layer to linseed oil was 30 degrees, while the contact angle $\theta$ of the surface of the ink-repelling resin layer to linseed oil was 67 degrees. By using the printing original plate, the same procedures as in Example 10 were further followed for thermal printing process with a thermal facsimile, the peeling and removal of the ink-philic resin layer on the printing part, and the printing test without dampening water. Thus, printed matters with sharp images were still obtained even after printing about 3,000 sheets of printed matters.

EXAMPLE 14

Polydimethylaminoethyl acrylate chloride (molecular weight of 20,000 to 3,000,000; manufactured by Nippon Shokubai, Co. Ltd.) was dissolved in methanol, and the resulting solution was coated onto a 0.2 mm-thick aluminium plate to a final dry thickness of 5 μm, followed by drying in hot air at 50° C. for 2 hours, thereby forming a conductive resin layer (first thermosensitive layer).

Applying the corona charge of 3 kV to the surface of the resin layer, the surface potential was measured, which was nearly 0 V.

The fluorine paint (the same as described above) (10 g as non-volatile component-converted value) and the styrene-acrylate butyl copolymer particles (the same as described above; 5 g) of an avarage particle size of 0.2 μm were dispersed by means of a paint shaker for 2 hours. The dispersion solution was coated onto the resulting conductive resin layer to a final dry thickness of 0.5 μm, followed by drying in hot air at 50° C. for 2 hours, thereby forming an insulating resin layer (second thermosensitive layer) with the particles dispersed therein.

As described above, the surface potential of the insulating resin layer was measured, which was 700 V.

A polyethylene film of a thickness of 30 μm was mounted onto the resulting resin layer, and rubbed with a heating roll at 50° to 60° C. for fixing, to produce an electrostatic recording material.

After the electrostatic recording material was subjected to thermal printing process with a thermal facsimile (the same as described above), the polyethylene film on the surface was peeled off. Thus, the insulating resin layer (second thermosensitive layer) on the printing part was peeled off and removed along with the film, thereby exposing the conductive resin layer (first thermosensitive layer) on the lower layer.

As described above, the surface potential of the resin layer at the Bart thermally printed was measured, which was nearly 0 V. It was confirmed that the conductive resin layer (first thermosensitive layer) on the lower layer was exposed.

Thereafter, development was done with toner after charging the substrate, thereby producing a master for electrostatic recording. By using the master, printing was done without dampening water on an offset printing machine (manufactured by Gestatener). Thus, printed matters with sharp images were still obtained even after printing about 3,000 sheets of printed matters.

EXAMPLE 15

The aqueous styrene-acrylate paint (the same as described above; 5 g as non-volatile component-converted value) was coated onto a 0.1-mm thick polyester film (substrate) to a final dry thickness of 5 μm, followed by drying in hot air at 80° C. for 2 hours, thereby forming a first thermosensitive resin layer.

Subsequently, the fluorine paint (the same as described above; 10 g as non-volatile component-converted value), the styrene-acrylate butyl copolymer particles (the same as described above; 5 g) of an average particle size of 0.2 μm and 0.5 g of a blue dye (manufactured by Mitsubishi Chemical Industry, Co. Ltd.; product name of "Diacryl Blue-GRL-N") were dispersed by means of a paint shaker for 2 hours. The dispersion solution was coated onto the first thermosensitive layer to a final dry thickness of 5 μm, followed by drying in hot air at 50° C. for 2 hours, thereby forming a second thermosensitive layer (blue).

A polyethylene film of a thickness of 30 μm was mounted onto the resulting resin layer, and rubbed with a heating roll at 40° to 50° C. for fixing, to produce a thermosensitive recording material.

After the thermosensitive recording material was subjected to thermal printing process with a thermal facsimilie (as described above), the polyethylene film on the surface was peeled off. Thus, the resin layer (second thermosensitive layer) containing the blue dye on the printing part was peeled off and removed along with the film, thereby exposing a transparent resin layer (first thermosensitive layer) without containing dyes or pigments on the lower layer.

EXAMPLE 16

The aqueous styrene-acrylate paint (the same as described above; 5 g as non-volatile component-converted value) and black acrylic particles of an average particle size of 4 μm (manufactured by Nippon Shokubai, Co. Ltd.) (10 g) were dispersed by means of a paint shaker for 2 hours. The resulting dispersion solution was coated onto a 0.1-mm thick polyester film (substrate) to a final dry thickness of 5 μm, followed by drying in hot air at 80° C. for 2 hours, thereby forming a first thermosensitive layer (black layer).

Subsequently, the fluorine paint (the same as described above; 10 g as non-volatile component-converted value), 4.5 g of a rutile-type titanium oxide (manufactured by Ishihara Industry, Co. Ltd.; product name of "Tie Pake CR-50") of an average particle size of 0.25 μm were dispersed by means of a paint shaker for 2 hours. The dispersion solution was subsequently coated onto the first thermosensitive layer obtained as above to a final dry thickness of 5 μm, followed by drying in hot air at 50° C. for 2 hours, thereby forming a second thermosensitive layer with the dye dispersed therein (white layer).

A polyethylene film of a thickness of 30 μm was mounted onto the resulting resin layer, and rubbed with a heating roll at 40° to 50° C. for fixing, to produce a thermosensitive recording material.

After the photosensitive recording material was subjected to thermal printing process with a thermal facsimilie (as described above), the polyethylene film on the surface was peeled off. Thus, the insulating resin layer (second thermosensitive layer) containing the blue dye on the printing part was peeled off and removed along with the film, thereby exposing a resin layer (first thermosensitive layer) without containing dyes or pigments on the lower layer, the exposed resin layer forming black portions, attaining the generation of sharp recording.

The black image part was measured of its reflection level by means of a Macbeth concentration device ("RD-914" a product name; manufactured by Macbeth, Co. Ltd.). The level was 1.54. The non-image part was measured as described above, which level was 0.10, with remarkable contrast.

EXAMPLE 17

Except that 5 g of an acrylic particle immobilized with γ-ferrite (γ-$Fe_2O_3$) (manufactured by Nippon Shokubai, Co. Ltd.) instead of the styrene-acrylate copolymer particle (the same as described above) and the blue dye, the same procedures as in Example 15 were followed to generate a magnetic recording material.

After the magnetic recording material was subjected to thermal printing process with a thermal facsimilie (as described above), the polyethylene film on the surface was peeled off. Thus, the resin layer (second thermosensitive layer) containing the magnetic particle was peeled off and removed along with the film, thereby exposing a non-magnetic resin layer (first thermosensitive layer) on the lower layer.

By using the plate, magnetic printing was done using an magnetic ink following a routine method. Consequently, printed matters with sharp images were still obtained even after printing about 3,000 sheets of printed matters.

EXAMPLE 18

A polyurethane resin (1 g as non-volatile component-converted value), 1 g of a vinyl chloride/vinyl acetate copolymer resin (non-volatile component-converted value), and 10 g of γ-ferrite (γ-$Fe_2O_3$) were dispersed in a mixture solvent of 10 g of toluene, 10 g of methyl ethyl ketone and 10 g of cyclohexane by means of a ball mill for 15 hours. The dispersion solution was subsequently coated onto a 0.1 mm-thick polyester film (substrate) to a final dry thickness of 5 μm, followed by magnetic orientation and drying in hot air at 80° C. for 2 hours, further followed by calendar processing, to produce a first thermosensitive layer (magnetic layer).

A silicon rubber paint of a room temperature curing type (the same as described above; 10 g as non-volatile component converted value) and 5 g of a styrene-butyl acrylate copolymer in particles of an average particle size of 0.2 μm (the same as described above) were dispersed by means of a paint shaker for 2 hours. The resulting dispersion solution was coated onto the first thermosensitive layer obtained as above to a final dry thickness of 10 μm, followed by drying in hot air at 50° C. for 2 hours, thereby forming a second thermosensitive layer (magnetically shielding layer).

A polyethylene film of a thickness of 30 μm was mounted onto the resulting resin layer, and rubbed with a heating roll at 40° to 50° C. for fixing, to produce a magnetic recording material.

After the thermosensitive recording material was subjected to bar code printing process without using a ribbon for a heat transfer card printer (manufactured by Autonix, Co. Ltd.), the polyethylene film on the surface was peeled off. Thus, the printing processed part of the resin layer (second thermosensitive layer) with the particles dispersed therein was peeled off and removed along with the film, thereby exposing the magnetic resin layer (first thermosensitive layer) on the lower layer.

By using the plate, recording was done with a magnetic head, with excellent recording results.

COMPARATIVE EXAMPLE 1

Except for skipping the process of dispersing particles into an ink-philic resin layer (first thermosensitive layer) and an ink-repelling resin layer (second thermosensitive layer), the same procedures as in Example 1 were followed to generate an original plate for lithographic printing. The contact angle $\theta$ of the surface of the ink-philic resin layer to linseed oil was 15 degrees, while the contact angle $\theta$ of the surface of the ink-repelling resin layer to linseed oil was 67 degrees. The same procedures as in Example 1 were further followed for thermal printing process with a thermal facsimile, the peeling and removal of the ink-philic resin layer on the printing part, and the printing test without dampening water. The image quality of a printed matter after printing about 10 sheets of printed matters was then compared with the quality of the printed matters in Example 1, which was far poorer as shown in Table 1.

COMPARATIVE EXAMPLE 2

Except that the fluorine paint in the ink-repelling resin layer (second thermosensitive layer) in Example 1 was replaced with a silicon rubber paint of a room temperature curing type ("KE 42S", manufactured by Shinetsu Chemical Industry, Co. Ltd.) and the aqueous styrene-acrylic paint was replaced with a modified silicon varnish ("LSI-60"; manufactured by Soken Chemicals, Co. Ltd.), the same procedures as in Example 1 were carried out to produce an original plate for lithographic printing. The contact angle $\theta$ of the surface of the ink-philic resin layer (first thermosensitive layer) to linseed oil was 37 degrees, while the contact angle $\theta$ of the surface of the ink-repelling resin layer (second thermosensitive layer) to linseed oil was 43 degrees. Following the same procedures as in Example 1, the thermal printing process with a thermal facsimile, the peeling and removal of the ink-repelling resin layer on the printing part, and the printing test without dampening water, were effected. As shown in Table 1, the greasing on the non-image part was serious, starting from a first printed matter. Thus, no excellent printed matters were produced.

COMPARATIVE EXAMPLE 3

Except that the binder in the first thermosensitive layer was replaced with a polyurethane resin of moisture hardening type ("Takeluck M-402" as product name; manufactured by Takeda Pharmaceutical Company, Co. Ltd.; solid concentration, 50 wt %), an original plate for lithographic printing was produced in the same manner as in Example 1. The contact angle e of the surface of the ink-philic resin layer to linseed oil was 23 degrees, while the contact angle $\theta$ of the surface of the ink-repelling resin layer to linseed oil was 67 degrees. The same procedures as in Example 1 were effected for the thermal printing process with a thermal facsimile and the peeling and removal of the ink-repelling resin layer (second thermosensitive layer) on the printing part. Then, the contact angle $\theta$ of the surface of the thermally printed part to linseed oil was 50 degrees with no sufficient decrease. The printing test without dampening water were effected. No ink was deposited on the surface of the thermally printed part.

COMPARATIVE EXAMPLE 4

Except that the coating film in Example 10 was replaced with a polyester film of about 12 $\mu$m, an original plate for lithographic printing was produced in the same manner as in Example 10. The contact angle $\theta$ of the surface of the ink-philic resin layer to linseed oil was 30 degrees, while the contact angle $\theta$ of the surface of the ink-repelling resin layer to linseed oil was 45 degrees. The same procedures as in Example 10 were effected for the thermal printing process with a thermal facsimile and the peeling and removal of the ink-repelling resin layer (first thermosensitive layer) on the printing part. Then, the contact angle $\theta$ of the surface of the thermally printed part to linseed oil was 45 degrees with no sufficient decrease. The printing test without dampening water were effected. No ink was deposited on the surface of the thermally printed part.

COMPARATIVE EXAMPLE 5

Using a silicon resin coated-mold release paper as a substrate, an ink-philic resin layer and an ink-repelling resin layer were sequentially layered on the surface of the silicon resin layer in the same manner as in Example 10, to produce an original plate for lithographic printing. The contact angle of the surface of the ink-philic resin layer to linseed oil was 30 degrees, while the contact angle $\theta$ of the surface of the ink-repelling resin layer to linseed oil was 45 degrees. Following the same procedures as in Example 10, the thermal printing process with a thermal facsimile and the peeling and removal of the ink-repelling resin layer (first thermosensitive layer) on the printing part were effected. Then, the resin layers were peeled off from the substrate. Thus, no printing plate could be produced.

COMPARATIVE EXAMPLE 6

Except that the binder in the first thermosensitive layer was replaced with a polyurethane resin of moisture hardening type (the same as described above), an original plate for lithographic printing was produced in the same manner as in Example 10. The contact angle $\theta$ of the surface of the ink-philic resin layer to linseed oil was 23 degrees, while the contact angle $\theta$ of the surface of the ink-repelling resin layer to linseed oil was 45 degrees. The same procedures as in Example 11 were effected for the thermal printing process with a thermal facsimile and the peeling and removal of the ink-repelling resin layer on the printing part. Then, the contact angle $\theta$ of the surface of the thermally printed part to linseed oil was 25 to 40 degrees with a large variation. The printing test without dampening water were effected. No sharp image was produced on a first printed matter.

EFFECT OF THE INVENTION

The present invention of the aforementioned constitution comprising forming on a substrate a thermosensitive recording layer composed of a first thermosensitive layer and a second thermosensitive layer, dispersing particles in at least one of the two, further forming a coating film layer thereon, thereby peeling off and removing a part of the first thermosensitive layer at a thermosensitively processed part and the second thermosensitive layer together with the coating film in a sharp manner to expose the first thermosensitive layer on the lower layer, whereby recording can be done at a higher precision in sharp manner, corresponding to the thermosensitively processed pattern for recording. By appropriately selecting the compositional materials of the first and second thermosensitive layers, the present invention is thus applicable extensively for use in original plates for lithographic printing, original plates for magnetic recording, original plates for electrostatic printing, original plates for colored image recording and the like.

TABLE 1

| | Example 1 | Example 2 | Comp. Exam. 1 | Comp. Exam. 2 |
|---|---|---|---|---|
| $\Delta\theta$ (Note 1) | 53° | 53° | 52° | 6° |
| Contact angle of image part (printing part) to linseed oil | less than 15° | less than 15° | 20~35° (with a larger variation | 37° |
| Image quality of printed image (Note 2) | ○ | ○ | X | X |

Note 1. The difference in contact angle to linseed oil between ink-repelling resin layer and ink-philic resin layer.
Note 2. After thermally printing the prepared original plate for lithographic printing with a thermal facsimile (Panafax, UF-83), the film was peeled off, which was then used as a printing plate to print 10 matters on high-quality paper by means of an offset printing machine (manufactured by Gestatener, Co. Ltd.), without dampening water. The images on the entire printed matters were visually observed.
Judgment:
○: Clear image without damage on fine letters and charts.
X: Unclear image with damaged fine letters and charts.

What is claimed is:

1. A thermosensitive recording material, comprising:
a substrate;
a coating film layer;
a recording layer;

wherein the recording layer is on the substrate, the coating film layer is on the recording layer, the recording layer is a bi-layer composed of a first thermosensitive layer including a matrix material and adjacent the substrate and a second thermosensitive layer including a matrix material and adjacent to the coating film layer, and particles are dispersed in at least one of the first and second thermosensitive layers; and wherein the first thermosensitive layer has the property that it is ink-philic and the second thermosensitive layer has the property that it is ink-repelling and wherein said particles have the same ink-philic or ink-repelling property as the thermosensitive layer in which they are dispersed.

2. A thermosensitive recording material, comprising:

a substrate;

a coating film layer;

a recording layer;

wherein the recording layer is on the substrate, the coating film layer is on the recording layer, the recording layer is a bi-layer composed of a first thermosensitive layer including a matrix material and adjacent the substrate and a second thermosensitive layer including a matrix material and adjacent the coating film layer, and particles are dispersed in at least one of the first and second thermosensitive layers; and wherein the first thermosensitive layer has the property that it is ink-repelling and the second thermosensitive layer has the property that it is ink-philic and wherein said particles have the same ink-repelling or ink-philic property as the thermosensitive layer in which they are dispersed.

3. A thermosensitive recording material comprising:

a substrate;

a recording layer on the substrate;

a coating film layer on the recording layer;

wherein the recording layer is formed from a bi-layer structure comprising a first thermosensitive layer that is adjacent to the substrate and a second thermosensitive layer that is adjacent to the coating film layer, the first and second thermosensitive layers are resin layers, either the first thermosensitive layer is an ink-philic layer and the second thermosensitive layer is an ink-repelling resin layer or vice versa; and particles being dispersed in the second thermosensitive layer.

4. A thermosensitive recording material, comprising:

a substrate;

a recording layer on the substrate;

a coating film layer on the recording layer;

wherein the recording layer comprises a bi-layer structure composed of a first thermosensitive layer that is adjacent to the substrate and a second thermosensitive layer that is adjacent to the coating film layer; and particles are dispersed in the first thermosensitive layer and in the second thermosensitive layer, the first thermosensitive layer comprising a first resin, the second thermosensitive layer comprising a second resin, wherein either the first resin is ink-philic and the second resin is ink-repelling or vice versa.

5. A thermosensitive recording material according to claim 1, wherein said particles are dispersed in said second thermosensitive layer.

6. A thermosensitive recording material according to claim 1, wherein said particles are dispersed in both of the first and the second thermosensitive layers.

7. A thermosensitive recording material according to claim 1, wherein a weight ratio between said particles and the matrix material of one of said first and second thermosensitive layers is 0.01 to 10.

8. A thermosensitive recording material according to claim 1 or claim 2, wherein the first and second thermosensitive layers are resin layers, a contact angle $\theta$ of the ink-repelling resin layer to linseed oil is 40 degrees or more and a contact angle $\theta$ of the ink-philic resin layer to linseed oil is less than 40 degrees and the difference in the contact angle between the two is 10 degrees or more.

9. A thermosensitive recording material according to claim 8 wherein the matrix material in the ink-repelling resin layer comprises as its principal component a silicon containing polymer.

10. A thermosensitive recording material according to claim 8, wherein the matrix material in the ink-philic resin layer comprises as its principal component a mixture of waxes and a synthetic resin.

11. A thermosensitive recording material according to any one of claims 1, 3, or 4, wherein said particles are formed from organic material.

12. A thermosensitive recording material according to claim 3 or 4, wherein an average particle size of said particles is 0.001 to 50 microns.

13. A thermosensitive recording material according to claim 3 or 4, wherein said particles comprise organic thermoplastic resin particles.

14. A thermosensitive recording material according to claim 3 or 4, wherein said coating film layer comprises a polyolefin resin.

15. A thermosensitive recording material according to claim 14, further comprising a second coating film layer containing a heat-resistant lubricating agent on the surface of said coating film layer.

16. A thermosensitive recording material according to claim 3 or 4, wherein the first and second thermosensitive layers are coatings.

17. A thermosensitive recording material according to claim 3 or 4, having laminate strength properties such that an interfacing peeling strength between the second thermosensitive layer and the coating film layer is lower prior to thermosensitizing than after thermosensitizing and a cohesive failure strength of the first thermosensitive layer is reduced by thermosensitizing.

18. A thermosensitive recording material according to claim 3 or 4, wherein said particles have a weight, the layer or layers with said particles dispersed therein have a weight, and a ratio of the weight of the dispersed particles to the weight of the resin of the layer or layers in which the particles are dispersed is between 0.01 and 10.

19. A thermosensitive recording material according to claim 3 or 4, wherein a contact angle $\theta$ of the ink-repelling resin layer to linseed oil is 40 degrees or more and a contact angle $\theta$ of the ink-philic resin layer to linseed oil is less than 40 degrees and the difference in the contact angle between the two resin layers is 10 degrees or more.

20. A thermosensitive recording material according to claim 19, wherein said particles have the same ink-philic or ink-repelling property as the thermosensitive layer in which they are dispersed.

21. A thermosensitive recording material according to claim 19 wherein the resin material in the ink-repelling resin layer comprises as its principal component a silicon containing polymer.

22. A thermosensitive recording material according to claim 19, wherein the resin material in the ink-philic resin layer comprises as its principal component a mixture of waxes and a synthetic resin.

23. A thermosensitive recording method comprising the steps of:

providing a thermosensitive recording material which comprises;

a substrate, a coating film layer, a recording layer, wherein the recording layer is on the substrate, the coating film layer is on the recording layer, the recording layer is a bi-layer composed of a first thermosensitive layer adjacent the substrate and a second thermosensitive layer adjacent the coating film layer, and particles are dispersed in a matrix material in at least one of the first and second thermosensitive layers, first, heating a recording part of the first and second thermosensitive layers while they are under pressure, second, peeling off the coating film layer, wherein said peeling off concurrently triggers cohesive failure in the recording part of the first thermosensitive layer thereby removing a part of the first thermosensitive layer that contacts the second thermosensitive layer and the recording part of the second thermosensitive layer together with the coating film layer from the substrate, thereby exposing a part of the first thermosensitive layer that is connected to the substrate.

24. A thermosensitive recording method according to claim 23 wherein either the first thermosensitive layer is a conductive resin layer and the second thermosensitive layer is an insulating resin layer or the first thermosensitive layer is an insulating resin layer and the second thermosensitive layer is a conductive resin layer, wherein said heating step further comprises heating the recording part under pressure from the side of the coating film layer and/or the substrate.

25. A thermosensitive recording method according to claim 23, wherein either (a) the first thermosensitive layer comprises a resin layer but does not contain a dye or a pigment and the second thermosensitive layer comprises a resin layer containing a dye and/or a pigment or (b) the first thermosensitive layer is a resin layer containing a dye and/or a pigment and the second thermosensitive layer is a resin layer containing a dye or a pigment of different colors and/or different concentrations from those in the first thermosensitive layer.

26. A thermosensitive recording method according to claim 23, wherein either (a) the first thermosensitive layer comprises a magnetic resin layer and the second thermosensitive layer comprises a magnetically shielding resin layer or (b) the first thermosensitive layer comprises a non-magnetic resin layer and the second thermosensitive layer comprises a magnetic resin layer.

27. A thermosensitive recording material, comprising:

a substrate;

a recording layer on the substrate, wherein the recording layer comprises a bi-layer structure comprising a first thermosensitive layer and a second thermosensitive layer, the first thermosensitive layer has a lower surface that is adjacent to the substrate and an upper surface, the upper surface of the first thermosensitive layer has a first region which is covered by and in contact with a lower surface of the second thermosensitive layer forming an interface thereat, and a second region that is not covered by and is not in contact with the second thermosensitive layer, wherein the first thermosensitive layer comprises a first resin and the second thermosensitive layer comprising a second resin, wherein particles are dispersed in the second thermosensitive layer and a ratio of weight of the dispersed particles to weight of the resin of the second thermosensitive layer is between 0.1 and 10, wherein either the first resin is ink-philic and the second resin is ink-repelling or vice versa, and wherein the second region of the upper surface of the first thermosensitive layer is lower than the interface between the first region of the first thermosensitive layer and the second thermosensitive layer.

28. A thermosensitive recording material according to claim 27, further comprising a coating film which, when removed, exposes said second region of said upper surface of the first thermosensitive layer and wherein:

the second region of the upper surface of the first thermosensitive layer is formed by peeling the coating film layer off of the recording layer thereby removing material in a region directly above the second region of the upper surface of the first thermosensitive layer.

29. A thermosensitive recording material according to claim 27, wherein the first thermosensitive layer comprises particles dispersed therein.

30. A thermosensitive recording material according to claim 27, wherein the average particle size is between 0.001 and 50 microns.

31. A thermosensitive recording material according to claim 27, wherein a contact angle $\theta$ of the ink-repelling resin layer to linseed oil is 40 degrees or more and a contact angle $\theta$ of the ink-philic resin layer to linseed oil is less than 40 degrees and the difference in the contact angle between the two resin layers is 10 degrees or more.

* * * * *